United States Patent [19]

Hickenbotham et al.

[11] Patent Number: 4,704,317

[45] Date of Patent: Nov. 3, 1987

[54] SHEETSTOCK DISPENSABLE FROM A CORNER NIP FEEDER

[75] Inventors: Brice G. Hickenbotham, North St. Paul; Gary R. Hanson, Minneapolis, both of Minn.

[73] Assignee: Minnesota Mining and Manufacturing Company, Saint Paul, Minn.

[21] Appl. No.: 907,172

[22] Filed: Sep. 15, 1986

Related U.S. Application Data

[63] Continuation-in-part of Ser. No. 782,964, Oct. 2, 1985, abandoned.

[51] Int. Cl.[4] ..... B32B 3/00

[52] U.S. Cl. ..... 428/156; 428/157; 428/192

[58] Field of Search ..... 428/156, 157, 192

[56] References Cited

U.S. PATENT DOCUMENTS

| | | | |
|---|---|---|---|
| 3,006,793 | 10/1961 | Wheeler, III | 154/53.5 |
| 3,035,957 | 5/1962 | Morgan | 154/53.5 |
| 3,859,157 | 1/1975 | Morgan | 156/268 |
| 3,900,645 | 8/1975 | Morgan | 428/41 |
| 4,265,441 | 5/1981 | Jonas | 271/19 |
| 4,447,481 | 5/1984 | Holmberg et al. | 428/40 |

*Primary Examiner*—John E. Kittle
*Assistant Examiner*—Patrick J. Ryan
*Attorney, Agent, or Firm*—Donald M. Sell; James A. Smith; John C. Barnes

[57] ABSTRACT

Sheetstock which is too stiff to be dispensed reliably from corner nip feeders is modifed to make it dispensible by forming a diagonal path of relatively low stiffness across each of at least two adjacent corners, preferably all four corners. Such a path preferably is made by forming slits, scores or a line of perforations extending at 45° to the edges of the sheetstock.

23 Claims, 10 Drawing Figures

SHEETSTOCK DISPENSABLE FROM A CORNER NIP FEEDER

CROSS REFERENCES TO RELATED APPLICATIONS

This application is a continuation-in-part of application Ser. No. 782,964, filed Oct. 2, 1985, now abandoned.

FIELD OF INVENTION

The invention concerns the problem of dispensing relatively stiff sheetstock from a corner nip feeder.

BACKGROUND ART

Copiers often are equipped with corner nip feeders which can be loaded with stacks of sheetstock of a given size for automatically feeding individual sheets into the copier. A corner nip feeder may employ a cartridge for convenience in changing the paperstock. Sometimes the corner nips are built into the cartridges, or they may be part of the copier as in U.S. Pat. No. 4,265,441 (Jonas). Corner nip feeders, with and without cartridges, are also employed in other machines such as printers. Because corner nip feeders typically are designed to dispense flexible sheetstock such as copying paper, they have not been useful for dispensing relatively stiff sheetstock, i.e., sheetstock having a diagonal Taber stiffness substantially exceeding 2 g-cm. In using machines equipped with typical corner nip feeders, it may be necessary to hand-feed sheetstock of such stiffness, e.g., sheets of transparency films, cardstock, and pressure-sensitive adhesive labelstock on releasable carriers.

DISCLOSURE OF INVENTION

The invention makes it feasible for the first time to reliably dispense relatively stiff sheetstock from a typical corner nip feeder. Briefly, the invention concerns sheetstock having a path of relatively low stiffness extending diagonally across each of two adjacent corners of the sheetstock to enhance dispensing from corner nip feeders. Each such path of low stiffness provides (as defined below) at a point on its Corner Stiffness Profile, a Corner Stiffness Value which is both (a) at least 0.2 g-cm less, and (b) at least 15% less than the Central Stiffness Value at the corresponding point along its Central Stiffness Profile for the same direction of bending.

By so modifying two adjacent corners, sheetstock that has a diagonal Taber stiffness exceeding 2 g-cm can be reliably dispensed from typical corner nip feeders, although to be reliably dispensed from virtually any corner nip feeder, each of said corners should have a Corner Stiffness Value which falls below the Preferred Maximum Reference Curve of FIG. 2 of the drawing. Because of their reduced stiffness, the corners flex and bend past the corner nips as if the sheetstock were ordinary copying paper. However, care should be taken to retain sufficient stiffness that the corners are not permanently folded upon passing the corner nips. Furthermore, an overly weakened corner might be accidentally folded during loading of a corner nip feeder, or it might be crumpled instead of being flexed when driven past the corner nips. To guard against these dangers, preferably no Corner Stiffness Value in either direction of bending for each corner of the sheetstock falls below the Preferred Minimum Reference Curve of FIG. 2.

It is preferred, when the sheetstock has no designated leading edge, that each of the four corners of the sheetstock has a diagonal path providing low stiffness so that the user does not need to be concerned about orienting the sheetstock correctly in a corner nip feeder. Preferably each diagonal path extends at 45° to the edges of the sheetstock so that the corner flexes in the same manner regardless of which edge of the sheetstock is the leading edge. Also, the Corner Stiffness Profiles for the four corners should be nearly identical in each direction of bending. Otherwise the sheetstock might be released by one of the corner nips before being released by the other, thus skewing the sheetstock. A Corner Stiffness Value for each corner in each direction of bending preferably is at least, 15% below the corresponding Central Stiffness Value so that the sheetstock can be dispensed from a corner nip feeder with either of its faces facing up.

The diagonal path of low stiffness may be formed by any of a number of procedures such as forming in one or both faces of each sheetstock at least one line of weakness, e.g., one or more scores, slits or lines of perforations. When a sheetstock comprises more than one layer, one or more diagonal lines of weakness, can be formed in one or more layers, e.g., by die-cutting one or more slits through one or more layers. Any such slit preferably does not extend completely across the corner, because the corner of that layer might be accidentally dislodged from the sheetstock. A diagonal path of low stiffness also can be provided by crushing the corners of the sheetstock to provide a path which may be quite narrow or so wide as to include the apex of the corner. Reduced stiffness can also be accomplished by chemically treating the corner either along a narrow or a wide path. Regardless of the procedure used, each of the aforementioned two adjacent corners, and preferably each of all four corners, is modified to reduce its stiffness sufficiently to permit the corners to flex and bend past the corner nips as if the sheetstock were ordinary copying paper.

When a path of low stiffness is provided by a score in one face of the sheetstock or a slit or line or perforations through an exposed face of a multi-layer sheetstock, the corner bends more easily in the direction away from that face. When the sheetstock is labelstock comprising pressure-sensitive adhesive facestock on a release carrier, the face of the labelstock will be face-up in most corner nip feeders, and it may be preferred to form scores, slits or perforations in the face of the labelstock to enhance bending of each corner away from the face of the labelstock. Even though slits, scores, and perforations can extend through the face of a sheetstock and be fairly unobtrusive upon viewing that face, they preferably do not extend across the face of any individual label. This can be readily accomplished when a labelstock has a gripper edge by keeping the entire path of low stiffness within the gripper edge. When this is not possible, it may be preferred to effect the reduced stiffness by chemical treatment or by confining slits, scores, and perforations to a disposable carrier.

The corner nips of most corner nip feeders are shaped as shown in FIG. 6 of the above-cited Jonas patent. Typically each corner nip extends about 0.5 cm along the leading edge of the sheetstock and about 1.0 cm along the side of the sheetstock. It might be surmised that to make a corner bend more easily, the diagonal path of low stiffness should extend parallel to and just beyond the oblique edge of the corner nip. Surprisingly, our tests indicate that equally good dispensability is achieved whether the diagonal paths extend parallel to the oblique edges of a typical corner nip or extend at 45° to the edges of the sheetstock. The latter is preferred so that the sheetstock feeds equally well regardless of whether the leading edge is at its broad side or its narrow side.

When a diagonal path of low stiffness has virtually no breadth, substantially its full length should lie outside of the corner nip when the sheetstock is stacked in a corner nip feeder. The distance between the apex of the corner of the sheetstock and the point at which such a path crosses a line bisecting the corner preferably is at least 0.7 cm, for use in typical corner nip feeders. On the other hand, that distance preferably does not exceed 1 cm, because our tests using the Taber stiffness tester have shown that a narrow diagonal path of low stiffness has its greatest effect on bendability when positioned only about 0.8 mm from the clamping jaws.

When a diagonal path of low stiffness has substantial breadth, it may be immaterial whether the path may be partially covered by a corner nip. For example, by crushing a corner including its apex, the stiffness of the entire corner preferably is reduced to approximate the stiffness of ordinary paper. In such event, substantially the entire length of the diagonal edge of the crushed corner should lie outside the corner nip. In other words, for use in typical nip corner feeders, the distance from the apex of the crushed corner to the intersection of the edge of that path more distant from the apex and a line bisecting the apex is at least 0.7 cm.

TESTING

The stiffness of sheetstock usually is measured in accordance with TAPPI standard T 489 os-76, which calls for specimens 1.5-inch (3.81-cm) square cut in the machine and cross directions. A specimen of different shape is required to test the stiffness of a corner, and the testing of that differently shaped specimen provides the "Corner Stiffness Values" described below.

An average from testing five sheets usually is adequate to determine whether a corner is of sufficiently low stiffness to be dispensed reliably from a typical corner nip feeder. In case of doubt, more exhaustive testing is recommended, both due to the nonuniformity of the sheetstock and due to inherent errors in individual test measurements. A minimum testing program in case of doubt calls for random selection of 20 test sheets, 4 sheets from each of 5 randomly selected packages of the sheetstock, and discarding the highest Right and Left set and the lowest Right and Left set of values from 20 the test sheets tested.

CORNER STIFFNESS VALUES

Cut from the corner is a pentagon (as shown in FIG. 1 of the drawing), the apex of the corner forming one angle and the adjacent sides of the pentagon. Each of the two adjacent angles is 135°, and each of the other two angles is 90°. The side of the pentagon opposite the apex is 1.5 inches (3.81 cm) in length, and the distance to that side from the apex is 1.5 inches (3.81 cm). The pentagon is mounted in a Taber stiffness tester (the face to be imaged, when identifiable, towards the R side of the tester). As taught in the TAPPI standard, the side opposite the apex of the pentagon is aligned against the bottom gauge of the tester. Using a 10-unit compensation weight, measurements are then made in the R and L directions. The pentagon is then removed, trimmed to remove $\frac{1}{8}$ inch (0.32 cm) from said opposite side, and retested, this procedure being repeated until said opposite side is 0.75 inch (1.905 cm) from the apex of the pentagon. Each such measurement is a Corner Stiffness Value. In the absence of any stiffness modification more than $\frac{3}{4}$ inch (1.9 cm) from the apex, the first Corner Stiffness Value usually will lie between the Taber stiffness values of the sheetstock in the machine and cross directions and may approximate the average of those values. Each subsequent Corner Stiffness Value reflects the reduced width of the portion of the pentagon being flexed by the Taber tester. Due to the short distance (1.1 cm) between the clamping jaws and the nip of the rollers of the Taber stiffness tester, a narrow diagonal path of low stiffness may fall between the clamping jaws and the rollers when measuring some of the Corner Stiffness Values, but not in measuring others.

When there is a diagonal path of reduced stiffness at a distance somewhat greater than 2.6 cm from the apex of the corner, the size of the pentagon cut for the Corner Stiffness Values must be enlarged. Because a stiffness discontinuity so far removed from the corner nips will have less effect than one less remote, there should be somewhat more than a 15% reduction in a Corner Stiffness Value compared to the corresponding Central Stiffness Value.

CORNER STIFFNESS PROFILE

A Corner Stiffness Profile is a graph of the Corner Stiffness Values versus the length of the line bisecting the apex of the pentagon.

CENTRAL STIFFNESS VALUES

A pentagon identical to that used for Corner Stiffness Values is cut from an unmodified central portion of the same sheetstock used for Corner Stiffness Values, but with a line bisecting the apex of the pentagon parallel to a line bisecting a corner of the sheetstock. It is positioned in the Taber tester with the same face towards the R side, and Central Stiffness Values are then determined in the same manner as are Corner Stiffness values. The average first Central Stiffness Value is the diagonal Taber stiffness of the sheetstock. If it does not equal the "First Corner Stiffness Value" mentioned in the explanation of Corner Stiffness Values, this indicates that the sheetstock is not uniform. In such event, the Corner Stiffness Profile is usually spaced from and roughly parallel to the Central Stiffness Profile except in areas affected by the diagonal path of relatively low stiffness.

CENTRAL STIFFNESS PROFILE

A Central Stiffness Profile is a graph of Central Stiffness Values versus the length of the line bisecting the apex of the pentagon.

THE DRAWING

The invention may be more readily understood with reference to the drawing in which:

FIG. 1 shows a pentagon cut from a corner of a sheetstock in order to test Corner Stiffness Values;

FIG. 2 is a graph of Corner Stiffness Profiles and Central Stiffness Profiles of sheetstock modified according to the invention, and includes a Preferred Maximum Reference Curve and a Preferred Minimum Reference Curve which are useful in determining whether sheetstock can be handled and reliably dispensed from typical corner nip feeders; and FIGS. 3–10 schematically and fragmentally illustrate sheetstock corners which have been modified according to the invention.

Referring first to FIG. 1, cut from a corner of a sheetstock 10 is a pentagon 11 of which two sides 12 and 13 are sides of the sheetstock and two sides 14 and 15 are parallel to each other and to a phantom line 17 which bisects the corner. A side 18 is opposite to the apex 16 of the corner and extends perpendicularly to the sides 14 and 15. Each of the angles 19 between the sides 12, 13 and between the sides 14, 15, respectively, is 135°.

In FIG. 2, the abscissa indicates distances along the phantom line 17 of FIG. 1 from the apex 16 of the corner to the side opposite the apex. The ordinate of FIG. 2 indicates stiffness values in g-cm.

In FIG. 2, curve 20 is the Central Stiffness Profile in the R direction of one corner of the sheetstock of Example 1, and curve 22 is its Corner Stiffness Profile in the R direction. The R profiles of Example 1 are shown rather than the L profiles, because they are considered to be more meaningful since sheetstock bends away from its outward face when being dispensed from a corner nip feeder.

Curve 24 shows a Preferred Maximum Reference Curve. For use in typical corner nip feeders, a Corner Stiffness Value of a sheetstock preferably falls below curve 24. Otherwise it might not be reliably dispensed. Curve 26 shows a Preferred Minimum Reference Curve.

FIG. 3 shows sheetstock, more specifically labelstock 30, consisting of a carrier web (not shown) to which is releasably adhered a facestock 32 including an underlying pressure-sensitive adhesive layer (not shown). The facestock 32 has been die-cut to form a diagonal slit 36 extending across at least two adjacent corners, one of which is shown. The slit 36 (which provides a diagonal path of relatively low stiffness) does not intersect either of edges 37 or 38 of the labelstock 30, thus insuring that the triangular portion of the facestock 32 beyond the slit does not accidentally become dislodged. The slit 36 extends at angles of 45° to each of the edges 37 and 38 of the labelstock 30, thus permitting equivalent performance when either edge 37 or edge 38 is the leading edge.

FIG. 4 shows a labelstock 40 including a facestock 42 which has been die-cut along line 44 to form a gripper edge 45. Two aligned 45° diagonal slits (or scores or lines of perforations) 46 in the facestock 42 do not intersect either the line 44 defining the gripper edge 45 or the edges 47 or 48 of the labelstock 40.

FIG. 5 shows a labelstock 50 including a facestock 52 which has been die-cut along line 54 to form a gripper edge 55. Three aligned 45° diagonal slits (or scores or lines of perforations) 56 in the facestock 52 extend substantially across the gripper edge 55 without intersecting either the line 54 or the edges 57 and 58 of the labelstock 50.

FIG. 6 shows a sheetstock 60 which has been die-cut, scored, or perforated along two parallel lines 66 that together form a diagonal path of relatively low stiffness, the breadth of which is the distance between the two lines 66.

FIG. 7 shows a sheetstock 70 which has been die-cut, scored, or perforated to along two aligned lines 75 and a third parallel line 76, thus forming a diagonal path of relatively low stiffness.

Figure 10:
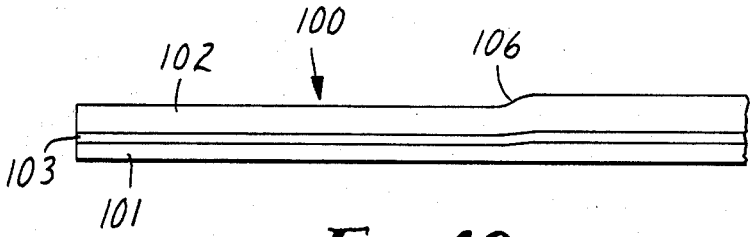

Shown in FIG. 10 is an edge view of a corner of a labelstock 100 comprising a carrier web 101 to which is releasably adhered facestock 102 including an underlying pressure-sensitive adhesive layer 103. The entire corner of the labelstock 100 has been crushed to provide a diagonal path of relatively low stiffness. The edge 106 of that path defines a substantially straight line which intersects the edges of the sheetstock 100 at 45°.

Each of the following examples was carried out on labelstock (21.6×27.8 cm) consisting of an imageable facestock bearing a releasable pressure-sensitive adhesive layer by which the facestock was adhered to a release liner. The facestock was Ardor bond paper available from Nekossa Paper Company, Port Edwards, Wis. having a thickness of 97 micrometers and a basis weight of 75 g/m$^2$. The release liner was a machine-finished paper having a thickness of 51 micrometers and a basis weight of 41 g/m$^2$. This labelstock was too stiff to be dispensed reliably from typical corner nip feeders.

In testing the examples, each Corner Stiffness Value and each Central Stiffness Value was an average from testing five sheets.

EXAMPLE 1

Figure 3:
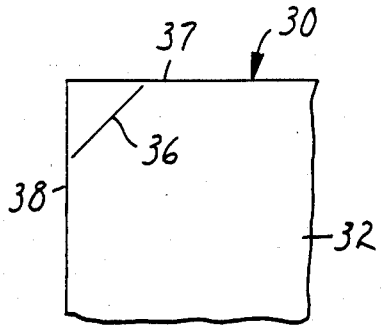

Each corner of a number of sheets of the labelstock was die-cut through the facestock to form a slit as illustrated in FIG. 3 of the drawing, each extending at 45° to the edge of the labelstock. The distance from the apex of the corner to the slit was 0.9 cm, and each end of the slit stopped about 0.8 mm short of the edge of the facestock measured in the direction of the slit.

EXAMPLE 2

Figure 4:
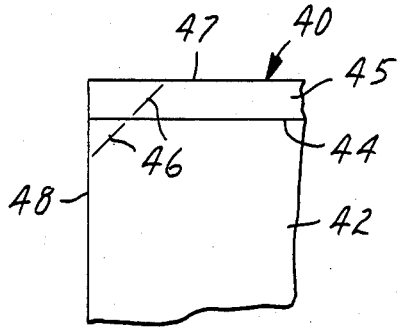

The labelstock was die-cut through the facestock to form 21 individual labels (each 3.8×7.2 cm) and a gripper edge 0.65 cm in width at each end. Simultaneously, each corner of the labelstock was die-cut to form two 45° slits as illustrated in FIG. 4 of the drawing. The distance from the apex of each corner to the line of the slits was 0.9 cm. The end of each slit stopped about 0.8 mm short of either the gripper die-cut or an edge of the facestock, measured in the direction of the slit.

EXAMPLE 3

Figure 5:
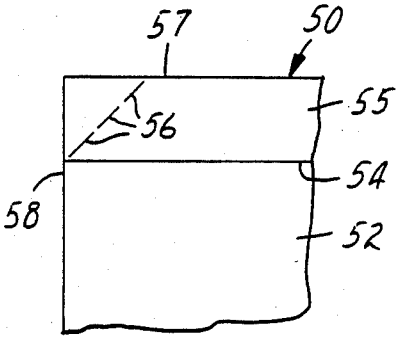

The facestock of the labelstock was die-cut as shown in FIG. 5 to form a gripper edge 1.27 cm in width and three aligned 45° slits spaced 0.8 mm from each other and 0.8 mm from the edges of the facestock, measured in the direction of the slits. The distance from the apex of each corner to the line of the slits was 0.9 cm.

EXAMPLE 4

Using a rotary die cutting machine, the labelstock was die-cut to form a gripper edge 1.27 cm in width and also each corner was crushed individually to a reduced thickness as illustrated in FIG. 10. The distance from the 45° edge 96 to the apex of the corner was 0.9 cm. In the crushed area, the thickness of the labelstock was reduced from about 153 micrometers to 133 micrometers.

EXAMPLE 5

Figure 6:
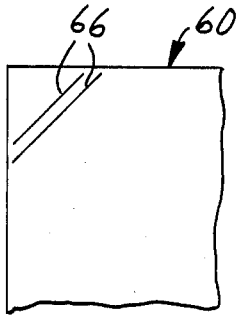
Figure 7:
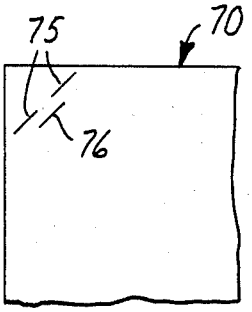
Figure 8:
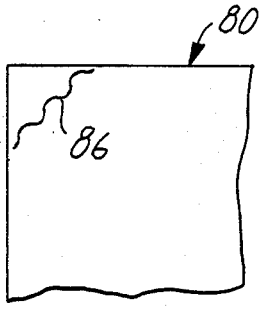
FIG. 8 shows a sheetstock 80, across the corner of which extends a serpentine slit, score, or line of perforations that provides a diagonal path 86 of relatively low stiffness across the corner.
Figure 9:
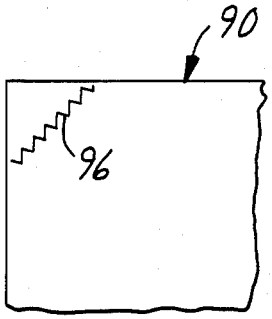
FIG. 9 shows a sheetstock 90, across the corner of which extends a sawtooth slit, score, or line of perforations that provides a diagonal path 96 of relatively low stiffness.

The facestock of the labelstock was die-cut to form two parallel 45° slits as shown in FIG. 6 except that the slits intersected the edges of the facestock. The slits were spaced 3.50 and 3.66 cm from the apex of each corner.

EXAMPLE 6

The facestock of the labelstock was chemically treated with "Downy" fabric softener (Proctor & Gamble) by moistening the label stock with a 5% solution of fabric softener in water by wiping an area spaced more than 2.6 cm from the apex of a corner with a towel wet with the solution. When the entire portion of the pentagon (3.81 cm width) between the clamping jaws and the rollers had been so treated and dried, the corner Stiffness Value was 2.4 in the R direction and 2.3 in the L direction, while Central Stiffness Values were R, 3.0 g-cm, and L, 2.9 g-cm.

EXAMPLE 7

A room temperature, 30% (by volume) solution of glycerol in water was coated and dried on three unmodified and undie cut sheets from the same lot. The coating was applied in the machine direction of the web by the use of a 7 cm wide 25 quadrangular screened rotogravure roll and the sheets were then dried without restraint in a convection oven at 60° C. for 10 minutes. The samples were then placed in a 22° C., 50% relative humidity room for 2.5 days to reach an equilibrium moisture. Pentagonal (3.8 cm wide and 3.8 cm from apex to bottom of sample) samples were cut in the diagonal direction from the sheets so that the whole sample area was treated. Single "point" measurements were made on each sample. The coated samples were found to have an average stiffness of 2.6 g-cm to the right and 2.4 g-cm to the left compared to Central Stiffness Values of 3.1 and 3.0 g-cm (a 16% and 20% reduction) respectively.

TEST RESULTS

Corner Stiffness Values and Central Stiffness Values for the first five examples are reported in Table A in g-cm. Also reported in Table A are values from which the Maximum Reference Curve and Minimum Reference Curve were generated. Because the diagonal paths of relatively low stiffness in the facestock of Example 5 was greater, 2.6 cm from the apex of the corner, it was necessary to cut larger test pentagons and to report the additional values in Table A-1.

TABLE A

| | Distance from apex to opposite side of pentagon | | | | | | | | | | | | | |
|---|---|---|---|---|---|---|---|---|---|---|---|---|---|---|
| | 1½" 3.81 cm | | 1⅜" 3.49 cm | | 1¼" 3.175 cm | | 1⅛" 2.86 cm | | 1" 2.54 cm | | ⅞" 2.22 cm | | ¾" 1.905 cm | |
| | R | L | R | L | R | L | R | L | R | L | R | L | R | L |
| 1 | | | | | | | | | | | | | | |
| Central | 3.00 | 3.16 | 2.82 | 3.01 | 2.52 | 2.73 | 2.15 | 2.38 | 1.81 | 1.95 | 1.37 | 1.44 | 0.68 | 0.82 |
| Corner | 2.89 | 2.96 | 2.58 | 2.82 | 2.40 | 2.50 | 2.10 | 2.15 | 0.84 | 1.24 | 0.85 | 1.18 | 0.62 | 0.66 |
| 2 | | | | | | | | | | | | | | |
| Central | 2.55 | 2.68 | 2.42 | 2.56 | 2.14 | 2.77 | 1.84 | 2.04 | 1.44 | 1.61 | 1.03 | 1.14 | 0.55 | 0.64 |
| Corner | 2.88 | 3.04 | 2.68 | 2.96 | 2.34 | 2.61 | 2.01 | 2.24 | 0.98 | 1.31 | 0.82 | 1.01 | 0.55 | 0.64 |
| 3 | | | | | | | | | | | | | | |
| Central | 3.00 | 2.89 | 2.85 | 2.84 | 2.55 | 2.48 | 2.11 | 2.11 | 1.64 | 1.67 | 1.18 | 1.32 | 0.67 | 0.72 |
| Corner | 2.93 | 2.90 | 2.75 | 2.76 | 2.48 | 2.58 | 1.95 | 2.05 | 0.93 | 1.11 | 1.06 | 1.15 | 0.63 | 0.69 |
| 4 | | | | | | | | | | | | | | |
| Central | 2.59 | 2.72 | 2.42 | 2.56 | 2.21 | 2.32 | 1.91 | 1.98 | 1.55 | 1.59 | 1.15 | 1.21 | 0.54 | 0.58 |
| Corner | 2.65 | 2.90 | 2.55 | 2.64 | 2.25 | 2.31 | 1.97 | 2.01 | 1.28 | 1.42 | 0.93 | 1.04 | 0.54 | 0.64 |
| 5 | | | | | | | | | | | | | | |
| Central | 2.74 | 3.04 | 2.70 | 3.01 | 2.40 | 2.60 | 2.02 | 2.24 | 1.72 | 1.82 | 1.21 | 1.32 | 0.64 | 0.77 |
| Corner | 2.65 | 3.05 | 2.68 | 2.96 | 2.51 | 2.71 | 2.17 | 2.43 | 1.68 | 1.96 | 1.27 | 1.43 | 0.70 | 0.84 |
| Maximum Reference Curve | 2.00 | | 1.92 | | 1.77 | | 1.55 | | 1.28 | | 0.94 | | 0.50 | |
| Minimum Reference Curve | 1.40 | | 1.34 | | 1.22 | | 1.04 | | 0.84 | | 0.62 | | 0.38 | |

TABLE A-1

| | Distance from apex to opposite side of pentagon | | | | | | | | | | | |
|---|---|---|---|---|---|---|---|---|---|---|---|---|
| | 2¼" 5.715 cm | | 2⅛" 5.40 cm | | 2" 5.08 cm | | 1⅞" 4.76 cm | | 1¾" 4.45 cm | | 1⅝" 4.18 cm | |
| | R | L | R | L | R | L | R | L | R | L | R | L |
| 5 (cont.) | | | | | | | | | | | | |
| Central | 2.72 | 2.93 | 2.77 | 2.91 | 2.70 | 3.01 | 2.68 | 3.01 | 2.72 | 2.98 | 2.74 | 3.02 |
| Corner | 2.78 | 3.00 | 1.04 | 1.58 | 0.67 | 1.05 | 1.04 | 1.58 | 2.03 | 2.53 | 2.55 | 2.86 |

Figure 1:
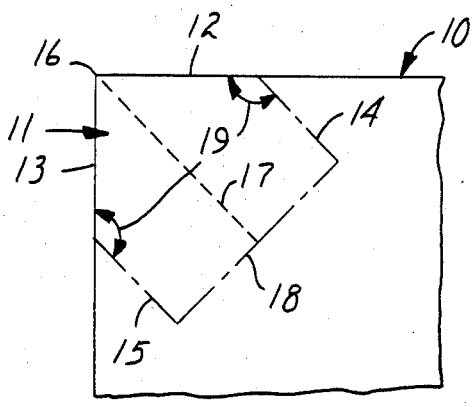
Figure 2:
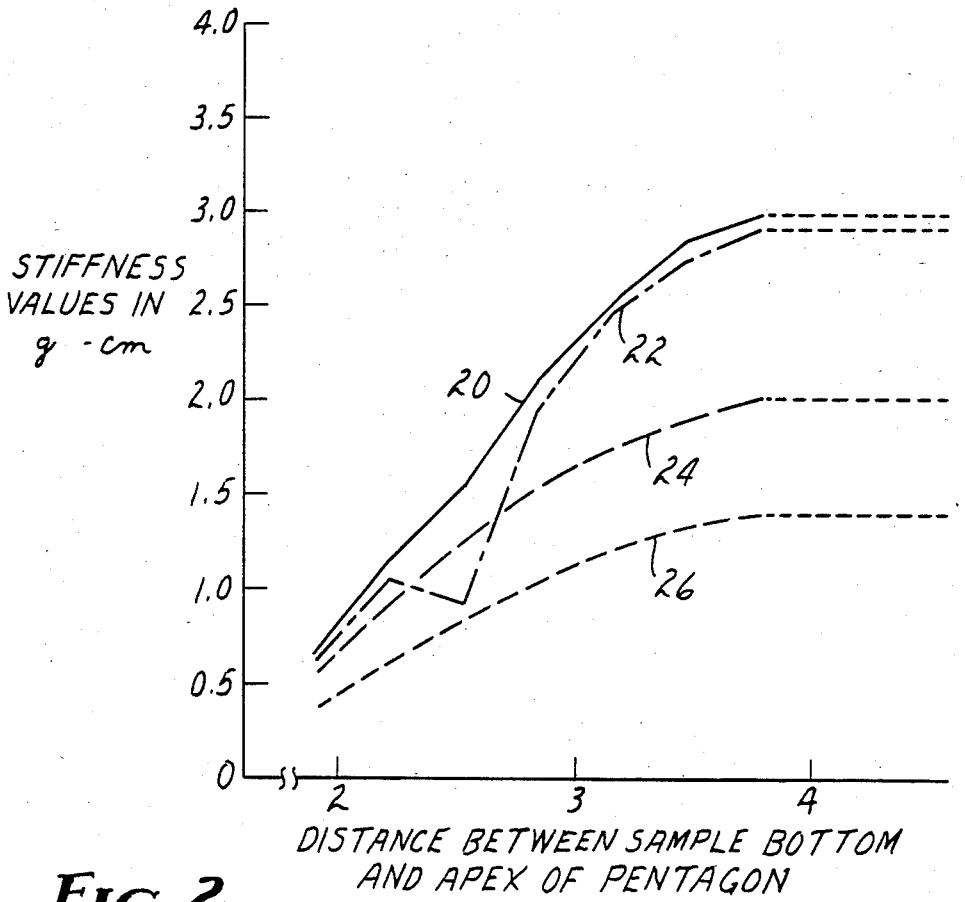

The Corner Stiffness Values and Central Stiffness Values of Ex. 1 in the R direction are graphed in FIG. 2 of the drawing. The Corner Stiffness Value at one inch (2.54 cm) falls about 54% below the corresponding Central Stiffness Value and midway below the Preferred Maximum and Minimum Reference Curve.

In the L direction, the Corner Stiffness Value at one inch falls about 36% and a little below the Preferred Maximum Reference Curve.

As indicated by these values, the labelstock of Ex. 1 with either face up should be reliably dispensible from, and in fact was reliably dispensed from a typical corner nip feeder.

The Corner Stiffness Profile in the R direction for the crushed corners of Example 4 approximates the Maximum Preferred Reference Curve at the points 2.54 cm and 2.22 cm. This labelstock was reliably dispensed from a typical corner nip feeder when positioned with the R face up.

We claim:

1. Sheetstock, which has a diagonal Taber stiffness exceeding 2 g-cm and a path of relatively low stiffness extending diagonally across each of two adjacent corners to enhance dispensing from a corner nip feeder, each of said corners having (as herein defined) at a point on its Corner Stiffness Profile, a Corner Stiffness Value which is both (a) at least 0.2 g-cm less and (b) at least 15% less than the Central Stiffness Value at the corresponding point along its Central Stiffness Profile for at least one direction of bending.

2. Sheetstock as defined in claim 1 wherein each of said adjacent corners has a Corner Stiffness Value which falls below the Preferred Maximum Reference Curve of FIG. 2 of the drawing.

3. Sheetstock as defined in claim 2 wherein no Corner Stiffness Value falls below the Preferred Minimum Reference Curve of FIG. 2.

4. Sheetstock as defined in claim 1 wherein a said path of low stiffness extends diagonally across each of its four corners.

5. Sheetstock as defined in claim 4 wherein the Corner Stiffness Profiles for the four corners are nearly identical in each direction of bending.

6. Sheetstock as defined in claim 1 wherein a Corner Stiffness Value, for each corner in each direction of bending is at least 15% below the corresponding Central Stiffness Value.

7. Sheetstock as defined in claim 1 wherein each diagonal path has virtually no breadth and the distance between the apex of each of said corners and the point where the path crosses a line bisecting the corner is from 0.7 cm to 1.0 cm.

8. Sheetstock as defined in claim 1 wherein each diagonal path has substantial breadth and the distance from the apex each of said corners to the intersection of the edge of that path more distant from the apex and a line bisecting the apex is at least 0.7 cm.

9. Sheetstock as defined in claim 6 wherein each path is defined by at least one line of weakness.

10. Sheetstock as defined in claim 9 wherein said line of weakness is defined by at least one slit.

11. Sheetstock as defined in claim 10 wherein the slit does not intersect an edge of the sheet.

12. Sheetstock as defined in claim 9 wherein said line of weakness is defined by perforations.

13. Sheetstock as defined in claim 9 wherein said line of weakness is defined by at least one score.

14. Sheetstock as defined in claim 9 wherein each path is defined by a plurality of lines of weakness extending substantially parallel to each other.

15. Sheetstock as defined in claim 6 comprising a labelstock comprising pressure-sensitive facestock on a releasable carrier, wherein said path is formed in the facestock.

16. Sheetstock as defined in claim 15 wherein each said path is provided by at least one line of weakness extending across the facestock but not intersecting its edges.

17. Sheetstock as defined in claim 16 wherein said line of weakness is defined by at least one slit, score, or line of perforations.

18. Sheetstock as defined in claim 7 where each diagonal path extends at 45° to the edges of the sheetstock.

19. Sheetstock as defined in claim 1 wherein the thickness within each said path is substantially less than the thickness of central portions of the sheet.

20. Method of modifying sheetstock to enhance dispensing from a corner nip feeder, said method comprising forming a path of relatively low weakness diagonally across each of two adjacent corners of the sheetstock to provide (as herein defined) a Corner Stiffness Value which is at least 15% less than the corresponding Central Stiffness Value for at least one direction of bending.

21. Method as defined in claim 20 comprising so forming each path to provide a Corner Stiffness Value which falls below the Preferred Maximum Reference Curve of FIG. 2 of the drawing.

22. Method as defined in claim 21 comprising so forming such a path across each of four corners.

23. Method as defined in claim 20 wherein each said diagonal path is formed by chemical treatment.

* * * * *